US008020672B2

(12) United States Patent
Lin et al.

(10) Patent No.: US 8,020,672 B2
(45) Date of Patent: Sep. 20, 2011

(54) VIDEO AIDED SYSTEM FOR ELEVATOR CONTROL

(75) Inventors: Lin Lin, Manchester, CT (US); Ziyou Xiong, Wethersfield, CT (US); Alan Matthew Finn, Hebron, CT (US); Pei-Yuan Peng, Ellington, CT (US); Pengju Kang, Yorktown Heights, NY (US); Mauro J. Atalla, South Glastonbury, CT (US); Meghna Misra, Manchester, CT (US); Christian Maria Netter, West Hartford, CT (US)

(73) Assignee: Otis Elevator Company, Farmington, CT (US)

( * ) Notice: Subject to any disclaimer, the term of this patent is extended or adjusted under 35 U.S.C. 154(b) by 565 days.

(21) Appl. No.: 12/087,217

(22) PCT Filed: Jan. 12, 2006

(86) PCT No.: PCT/US2006/001376

§ 371 (c)(1),
(2), (4) Date: Jun. 26, 2008

(87) PCT Pub. No.: WO2007/081345

PCT Pub. Date: Jul. 19, 2007

(65) Prior Publication Data

US 2009/0057068 A1 Mar. 5, 2009

(51) Int. Cl.
*B66B 1/34* (2006.01)

(52) U.S. Cl. ..... 187/392; 187/316

(58) Field of Classification Search ..... 187/247, 187/248, 380–388, 391–393, 316, 277
See application file for complete search history.

(56) References Cited

U.S. PATENT DOCUMENTS

| | | | | |
|---|---|---|---|---|
| 4,044,860 | A | 8/1977 | Kaneko et al. | |
| 4,662,479 | A | 5/1987 | Tsuji et al. | |
| 5,182,776 | A | 1/1993 | Suzuki et al. | |
| 5,258,586 | A | 11/1993 | Suzuki et al. | |
| 5,298,697 | A | 3/1994 | Suzuki et al. | |
| 5,387,768 | A | 2/1995 | Izard et al. | |
| 6,257,373 | B1 * | 7/2001 | Hikita et al. | 187/392 |
| 6,386,325 | B1 | 5/2002 | Fujita | |

(Continued)

FOREIGN PATENT DOCUMENTS

EP 1074958 B1 12/2004

(Continued)

OTHER PUBLICATIONS

Intellivision, "Products", http://www.intelli-vision.com/Products.htm, pp. 1-2, 2005.

(Continued)

*Primary Examiner* — Anthony Salata
(74) *Attorney, Agent, or Firm* — Kinney & Lange, P.A.

(57) ABSTRACT

An elevator control system (24) provides elevator dispatch and door control based on passenger data received from a video monitoring system. The video monitoring system includes a video processor (16) connected to receive video input from at least one video camera (12). The video processor (16) tracks objects located within the field of view of the video camera, and calculates passenger data parameters associated with each tracked object. The elevator controller (24) provides elevator dispatch (26), door control (28), and security functions (30) based in part on passenger data provided by the video processor (16). The security functions may also be based in part on data from access control systems (14).

22 Claims, 6 Drawing Sheets

U.S. PATENT DOCUMENTS

| | | | | |
|---|---|---|---|---|
| 7,353,915 | B2 * | 4/2008 | Zaharia et al. | 187/388 |
| 2004/0017929 | A1 | 1/2004 | Bramblet et al. | |
| 2004/0188185 | A1 | 9/2004 | Pieper | |

FOREIGN PATENT DOCUMENTS

| | | | |
|---|---|---|---|
| WO | 2004084556 | A1 | 9/2004 |
| WO | W02005118452 | A1 | 12/2005 |

OTHER PUBLICATIONS

Dick et al., "Issues in Automated Visual Surveillance", School of Computer Science, Adelaide, Australia. 2003.

Bose et al., "Improving Object Classification in Far-Field Video", Computer Science and Artificial Intelligence Laboratory, pp. 1-8, Cambridge, MA, USA. 2004.

Merkus et all, "Candela—Integrated Storage, Analysis and Distribution of Video Content for Intelligent Information Systems". 2004.

Madhaven et al., "Moving Object Prediction for Off-road Autonomous Navigation", National Institute of Standards and Technology (NIST), Gaithersburg, MD, USA. 2003.

* cited by examiner

VIDEO AIDED SYSTEM FOR ELEVATOR CONTROL

BACKGROUND

The present invention relates generally to the field of elevator control, and more particularly to providing a video aided system that improves elevator dispatch, door control, access control, and integration with security systems.

Elevator performance is derived from a number of factors. To a typical elevator passenger, the most important factor is time. As time-based parameters are minimized, passenger satisfaction with the service of the elevator improves. The overall amount of time a passenger associates with elevator performance can be broken down into three time intervals.

The first time interval is the amount of time a passenger waits in an elevator hall for an elevator to arrive, hereafter the "wait time". Typically, the wait time consists of the time beginning when a passenger pushes an elevator call button, and ending when an elevator arrives at the passenger's floor. Methods of reducing the wait time have previously been focused on reducing the response time of an elevator, either by using complex algorithms to predict passenger demand for service, or reducing the amount of time it takes for an elevator to be dispatched to the appropriate floor.

The second time interval is the "door dwell time" or the amount of time the elevator doors are open, allowing passengers to enter or leave the elevator. It would be beneficial to minimize the amount of time the elevator doors remain open, after all waiting passengers have entered or exited an elevator cab.

The third time interval is the "ride time" or amount of time a passenger spends in the elevator. If a number of passengers are riding on the elevator, then the ride time may also include stops on a number of intermediate floors.

A number of algorithms have been developed to minimize the wait time a passenger spends in the elevator hall. For instance, some elevator control systems use passenger flow data to determine which floors to dispatch elevators to, or park elevators at, depending on the time of day. Typically, requesting deployment of an elevator by pushing the call button results in a single elevator being dispatched to the requesting floor. In situations in which the number of passengers waiting on the requesting floor is greater than the capacity of the elevator, at least some passengers will have to wait until after the first elevator leaves, and then push the call button again to request a second elevator be sent to the requesting floor. This results in an increase in the overall wait time for at least some of the passengers. In a similar situation, a particular elevator cab carrying the maximum number of passengers may continue to stop on floors requesting elevator service. Because no new passengers can enter the elevator, the ride time of passengers on the elevator is increased unnecessarily, as is the wait time for passengers in the elevator hall.

Many elevator systems are also integrated with access control and security systems. The goal of these systems is to detect, and if possible, prevent unauthorized users from gaining access to secure areas. Because elevators act as access points to many locations within a building, elevator doors and cabs are well suited to perform access control. A number of schemes have been devised to defeat traditional access control systems, such as "card pass back" and "piggybacking". Card pass back occurs when an authorized user (typically using a card swipe) provides his card to an unauthorized user, allowing both the authorized user and the unauthorized user to gain access to a secure area. Piggybacking occurs when an unauthorized user attempts to use an authorization provided by an authorized user to gain access to a secure area (either with or without the knowledge of the authorized user).

Therefore, it would be useful to design an elevator system that could minimize wait times experienced by passengers, while providing improved security or access control.

BRIEF SUMMARY OF THE INVENTION

In the present invention, a video monitoring system provides passenger data to an elevator control system. The video monitoring system includes a video processor connected to receive video input from at least one video camera mounted to monitor the area outside of elevator doors. The video processor uses sequential video images provided by the video camera to track objects outside of the elevator doors. Based on the video input received, the video processor calculates a number of parameters associated with each tracked object. The parameters are provided to the elevator control system, which uses the parameters to efficiently operate the dispatch of elevator cabs and control of elevator door opening and closing.

DETAILED DESCRIPTION

Figure 1A:
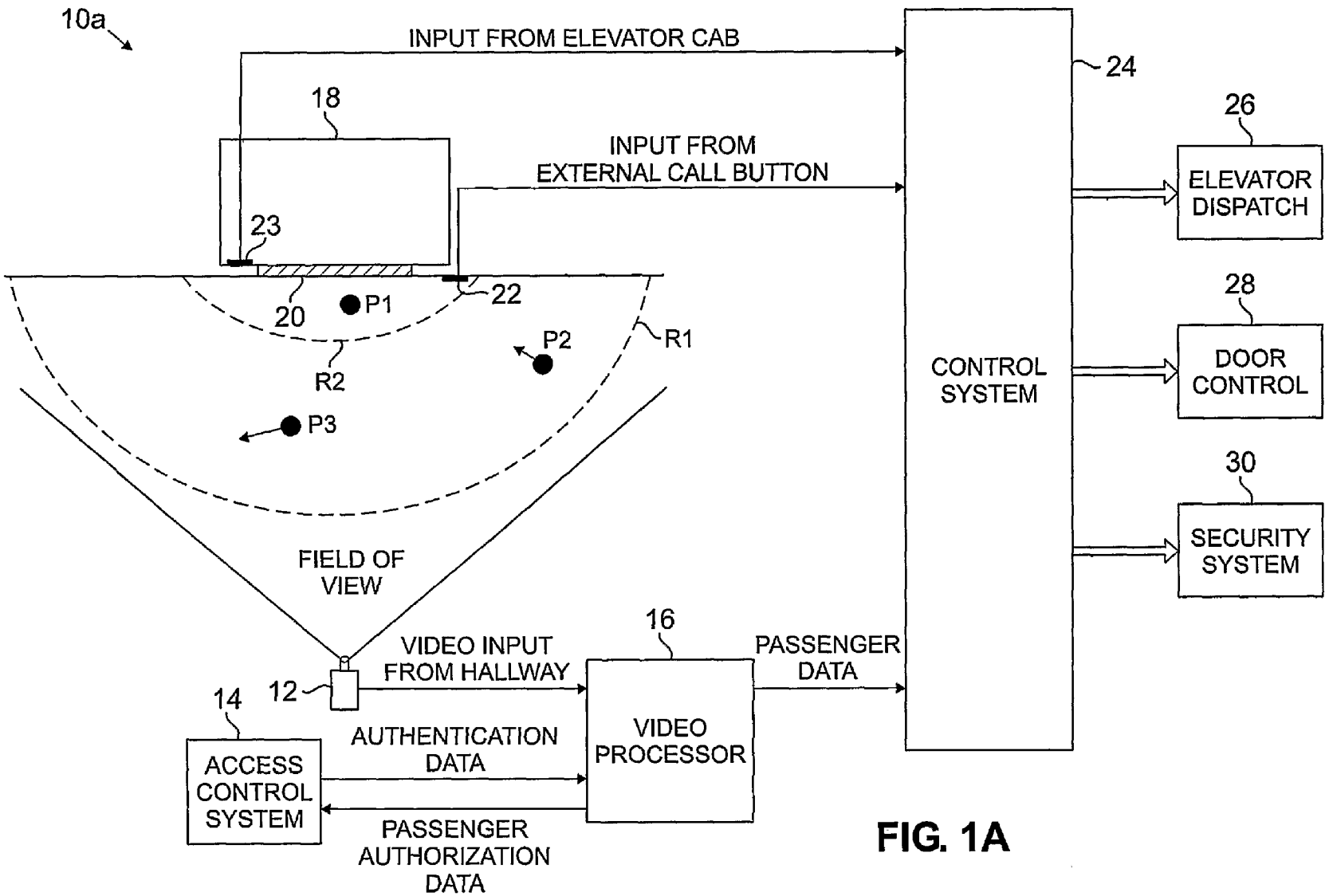
FIGS. 1A and 1B are schematic/functional block diagrams of a video aided elevator and access control system of the present invention.
Figure 1B:
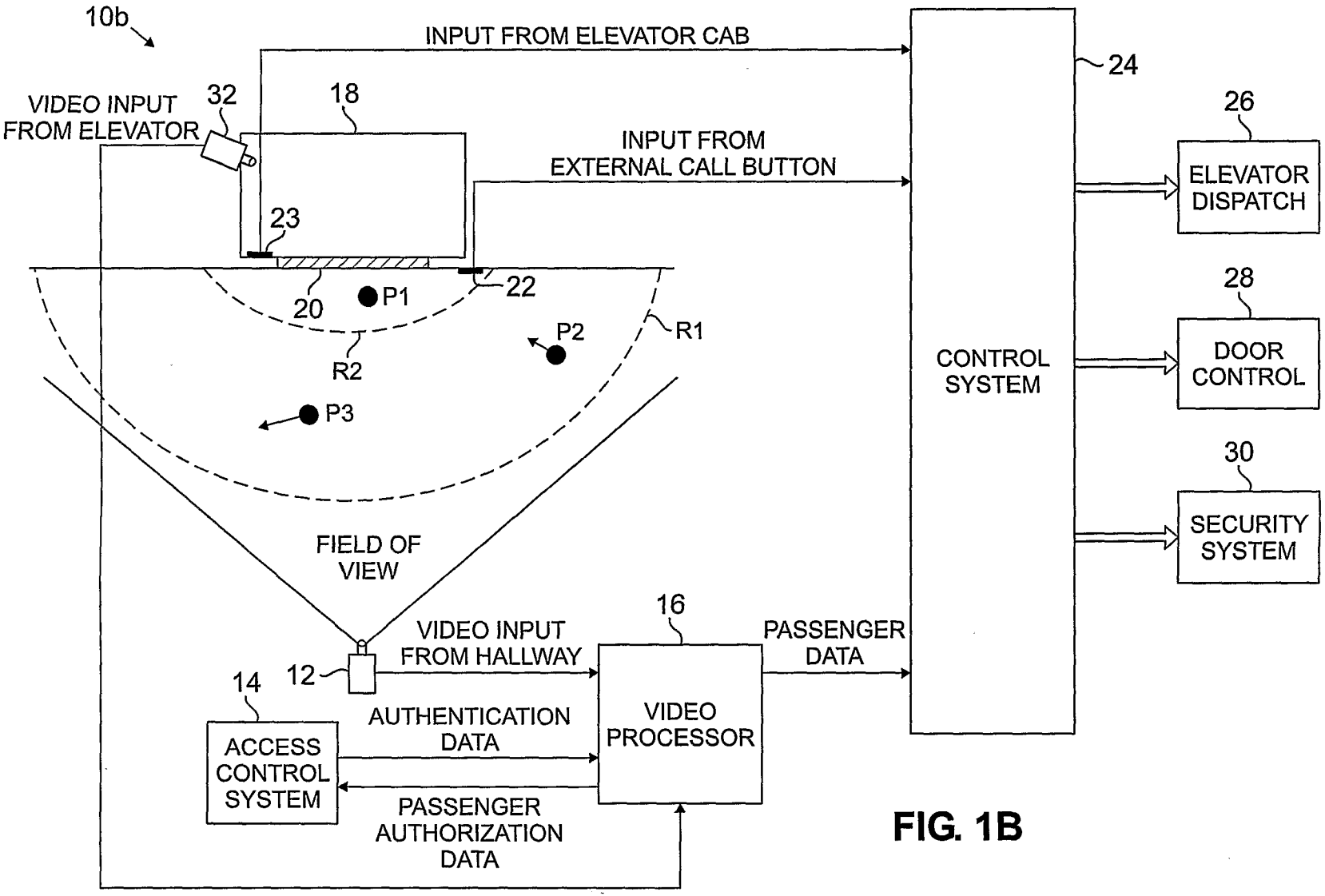

FIGS. 1A and 1B are schematic/functional block diagrams of video aided elevator and access control systems ("elevator system") 10*a* and 10*b*, respectively, of the present invention. In FIG. 1A, elevator system 10*a* includes video camera 12, access control system 14, video processor 16, elevator cab 18, elevator doors 20, elevator hall call button 22, elevator cab control panel 23, and control system 24 which provides control signals to elevator dispatch 26, door control 28, and security system 30. The primary purpose of video camera 12 may have been as part of security system 30 in which case video processor 16 uses existing camera 12 for the purpose of this invention. In FIG. 1B, elevator system 10*b* also includes a second video camera 32 located within elevator cab 18 to provide video input to video processor 16 regarding the interior of elevator cab 18. As with video camera 12, video camera 32 may have a primary purpose other than its use in this invention, in which case video processor 16 uses the existing camera for the purpose of this invention.

In both FIGS. 1A and 1B, control system 24 provides control signals to elevator dispatch 26, door control 28, and security system 30 based on input signals received from elevator cab 18, elevator call button 22, and video processor 16. Although control system 24 is shown as a single block in FIGS. 1A and 1B, in other embodiments, independent controllers may be employed for elevator dispatch, door control and/or security. Control signals provided to elevator dispatch 26 determine the floor destination(s) of elevator cab 18. Control signals provided to door control 28 determine when elevator doors 20 are opened or closed. Control signals provided to security system 30 alert a security system to the presence of an unauthorized passenger or object, or other security related concern detected by video processor 16.

Input from elevator call button 22 notifies control system 24 of the presence of a passenger at elevator doors 20, awaiting elevator service. These inputs are common to most elevator systems, in which a passenger reaches elevator doors 20 and pushes external call button 22 to request elevator service at his/her floor location. In response, control system 24 dispatches elevator cab 18 to the appropriate floor. Once inside elevator cab 18, the passenger pushes a button on control panel 23 corresponding with the desired floor location, and control system 24 dispatches elevator cab 18 to the desired floor.

Video processor 16 provides passenger data to control system 24, providing control system 24 with additional information regarding elevator passengers. Throughout this application, the term 'object' refers generically to anything not identified as background by a video processor. Typically, 'objects' are the focus of video processing algorithms designed to provide useful information with respect to a video camera's field of view. The term 'passenger' refers generically to objects (including people, carts, luggage, etc.) that are or may potentially become elevator passengers. In many cases, objects are in fact passengers. However, as discussed with respect to FIG. 3, in some instances, video processor 16 may determine that an object is not a potential passenger, and classify it as such. In one embodiment, video processor 16 provides control system 24 with data (passenger data) corresponding only to objects classified as passengers. In other embodiments, passenger data is calculated and provided to control system 24 regardless of the classification of an object as a passenger or not.

Control system 24 uses passenger data provided by video processor 16, in conjunction with data provided by elevator cab 18 and elevator call button 22, to improve performance (e.g., wait time, door dwell time, and ride time) of elevator system 10. For example, early detection of passengers by video processor 16 allows control system 24 to dispatch elevator cab 18 to a particular floor prior to the passenger pushing call button 22.

As shown in FIG. 1A, video processor 16 receives video images from video camera 12, and access control data from access control system 14. Video camera 12 is orientated to monitor traffic outside of elevator doors 20. The orientation of video camera 12 may be determined based on the location of elevator doors 20 and direction of traffic to and from elevator doors 20. As shown in FIG. 1A, video camera 12 is preferentially located across from elevator doors 20 such that objects located within the field of view of video camera 12 can be monitored. Alternatively, if there is only one video camera 12 (as in FIG. 1A), the camera could be located within elevator cab 18 to have substantially similar field of view R1 as depicted in FIG. 1A, but only when elevator doors 20 are open. Video data captured by video camera 12 is provided to video processor 16 for video analysis. A number of video analysis methods may be employed. For example, Intelligent Video™ software by Intellivision Company provides video content analysis (VCA) that allows video processor 16 to track and classify objects within the field of view of video camera 12. Tracking is defined as being able to identify and associate an object detected at a first point in time with an object detected at a second point in time. The ability to track an object allows video processor 16 to perform calculations such as direction and speed of a particular object. For each tracked object, video processor 16 calculates a number of variables, such as position, speed, direction, and acceleration. Classification is defined as being able to identify the type of an object whether it is a person, an animal, or a bag, etc. Video processor 16 uses these parameters to determine whether a tracked object is a potential passenger and to calculate passenger data with respect to objects classified as passengers.

As shown in FIG. 1B, additional video camera 32 located in elevator cab 18 provides video input with respect to the interior of elevator cab 18 to video processor 16. Based on the video input provided, video processor 16 calculates a number of parameters that are then provided to control system 24. For instance, video processor 16 determines the number of passengers or other usage parameters in elevator cab 18, as well as the available elevator cab area for additional passengers. Control system 24 uses these parameters to make decisions regarding dispatch of elevator cab 18 as well as door control of elevator doors 20. For example, if video processor 16 determines that elevator cab 18 contains no available space for additional passengers, then control system 24 causes elevator cab 18 to bypass floors with waiting passengers. This prevents the situation in which an elevator filled to capacity stops at a floor, increasing the ride time of passengers within the elevator cab, and the wait time for passengers waiting for an elevator, since they must now wait for another elevator to be dispatched to their floor.

As shown in FIGS. 1A and 1B, video processor 16 divides the field of view of video camera 12 into two regions, R1 and R2. Region R1 is nearly co-extensive with the field of view of video camera 12, and defines the area in which video processor 16 tracks objects. Region R2 defines an area around elevator doors 20, approximately coextensive with the area in which elevator passengers will wait for elevator cab 18 to arrive. Rather than continuing to track objects within region R2, video processor 16 determines that any object that enters region R2 on an appropriate trajectory and not from inside the elevator cab 18 is most likely a passenger waiting for an elevator. This allows video processor 16 to maintain an accurate count of the number of passengers waiting for elevator cab 18.

In FIGS. 1A and 1B, access control system 14 provides input to video processor 16 regarding authentication or access status of an object or passenger. A number of methods may be used to implement access control, including remote authentication of passenger status, elevator door authorization, and elevator cab authorization. Remote authentication may employ radio frequency identification cards, allowing access control system 14 to determine passenger authentication as the passenger approaches elevator doors 20. Elevator door authorization determines passenger authorization at elevator door 20, prior to the passenger entering elevator cab 18. Elevator cab authorization determines passenger authorization within elevator cab 18. Authorization may be performed by one or more of any well known means including using something the authorized person knows, e.g., a password, something the authorized person has, e.g., a machine-readable identity card, or something the authorized person is, e.g., a biometric authentication feature such as fingerprint, voice, or face. Facial recognition may be particularly advantageous since the video processor 16 may additionally perform the authentication function of access control system 14.

As shown in FIG. 1B, video camera 32 allows video processor 16 to unambiguously associate an authorization with a passenger located within elevator cab 18 (in contrast with the system shown in FIG. 1A, in which video processor 16 associates authorization with passengers waiting outside of elevator doors 20). Video processor 16 provides authentication data associated with each elevator passenger to control system 24. Based on authorization data provided, control system 24 is able to detect and possibly prevent security breaches, as discussed in more detail below with respect to FIG. 4.

Based on video input provided by video camera 12 (and video camera 32 as shown in FIG. 1B), and authorization data provided by access control system 14, video processor 16 provides passenger data for each tracked object classified as a passenger to control system 24. A non-exhaustive list of passenger data parameters provided by video processor 16 to control system 24 includes:

(1) Estimated Arrival Time
(2) Probability of Arrival
(3) Covariance
(4) Object Type (person, luggage, wheel-chair)
(5) Object Size (floor size to be occupied)
(6) Number of passengers waiting for elevator
(7) Object Authorization To illustrate the usefulness of each of these parameters, they are described below with respect to passengers P1, P2, and P3 shown in FIG. 1A. For purposes of this example, passenger P1 is waiting outside elevator doors 20 in region R2, passenger P2 is walking towards elevator doors 20 in region R1, and passenger P3 is walking away from elevator doors 20 in region R1. For each object classified as a passenger, video processor 16 provides a set of passenger data to control system 24. As discussed above, in other embodiments video processor 16 may provide passenger data (as well as object parameters such as location, speed, direction, acceleration, etc) to control system 24 regardless of the classification of an object as a passenger.

Estimated Arrival Time, Probability of Arrival, and Covariance

Estimated arrival time is a prediction of the amount of time it will take an identified object to arrive at a specified location, for example, elevator doors 20. Probability of arrival is the likelihood that an identified object will arrive at a particular location, for example, elevator doors 20. Covariance is a statistical measure of the confidence associated with the estimated arrival time and probability of arrival. Each of these three parameters are closely related to one another, and are therefore described together.

Figure 2A:
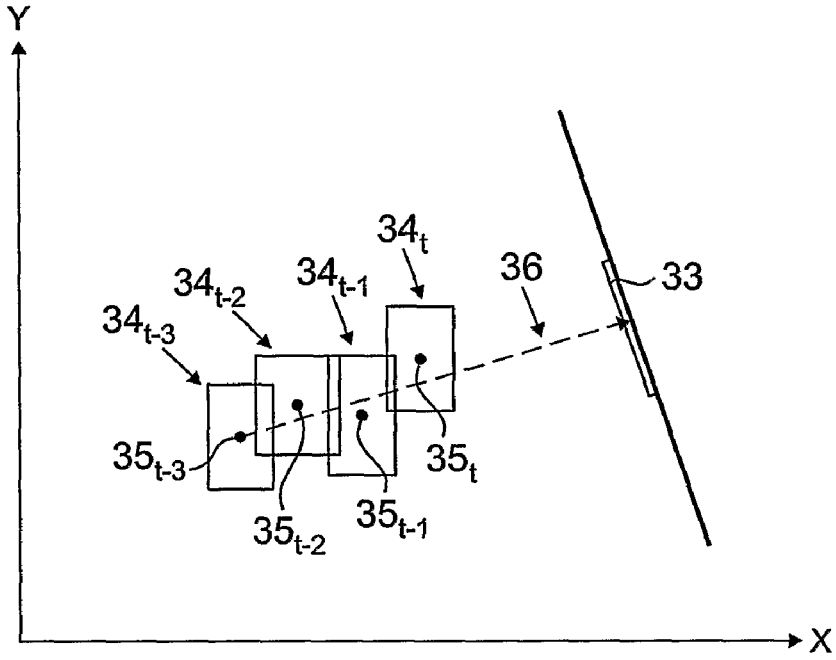
FIG. 2A is a diagram illustrating calculation of mean estimated arrival time, probability of arrival, and covariance.
Figure 2B:
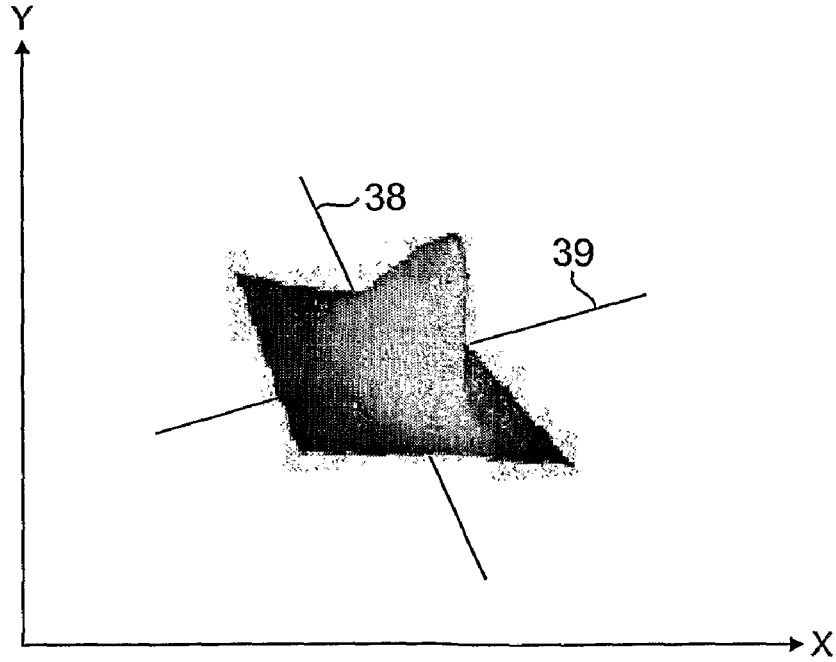
FIG. 2B is a two dimensional graphical representation of covariance.

FIGS. 2A and 2B show an embodiment of how video processor 16 calculates covariance, estimated arrival time, and probability of arrival. FIG. 2A shows elevator doors 33 defined in an x-y coordinate system. An object is tracked through the x-y coordinate system at four instances in time, shown by bounding boxes $\mathbf{34}_t$, $\mathbf{34}_{t-1}$, $\mathbf{34}_{t-2}$, and $\mathbf{34}_{t-3}$. Each bounding box is defined such that the tracked object is encompassed within the bounding box. In one embodiment, each bounding box is generated to include all pixels in a particular frame that video processor 16 identifies as showing associated, coordinated motion. Centroids $\mathbf{35}_t$, $\mathbf{35}_{t-1}$, $\mathbf{35}_{t-2}$, and $\mathbf{35}_{t-3}$ are defined at the center of each bounding box $\mathbf{34}_t$, $\mathbf{34}_{t-1}$, $\mathbf{34}_{t-2}$, and $\mathbf{34}_{t-3}$, respectively. Defining centroids at the center of each bounding box provides a point at which to calculate object parameters such as position, velocity, direction, etc. Calculating object parameters using centroids reduces error in determining the actual location of an object within the field of view. This problem is particularly relevant when tracking the movements of people.

Based on object parameters (e.g., location, speed, direction, etc.) calculated with respect to centroids $\mathbf{35}_t$, $\mathbf{35}_{t-1}$, $\mathbf{35}_{t-2}$, and $\mathbf{35}_{t-3}$, video processor 16 determines the predicted path of the object shown by line 36. The predicted path shown by line 36 defines the most probable future location of the tracked object. Based on the object parameters, including current location of the tracked object (i.e., centroid $\mathbf{35}_t$), and distance to a location determined by the predicted path, video processor 16 defines the estimated time at which the tracked object will reach a particular point in the x-y coordinate system. The estimation of arrival time may use more complicated models of expected object motion, such as anticipating an object slowing down as it approaches the elevator call button 22 or elevator door 20. Thus, the estimated time of arrival is the most likely time at which the tracked object reaches the x-y coordinate defining elevator door 33. Likewise, the probability of arrival is the probability that the tracked object will travel to the x-y coordinate defining elevator door 33.

FIG. 2B is a two-dimensional representation of the covariance associated with the tracked object arriving at elevator doors 33 (as shown in FIG. 2A). Axis 38 is defined in the x-y coordinate system to be coextensive with the location of elevator doors 33. Axis 39 is defined in the x-y coordinate system along the predicted path of the passenger shown by line 36 in FIG. 2A. The covariance defines the confidence or certainty with which video processor 16 calculates the probability of arrival and the estimated arrival time.

In one embodiment, the covariance distribution is calculated using an Extended Kalman Filter (EKF), and is based on the following factors, including: target dynamics, state estimates, uncertainty propagation, and statistical stationarity of the process. Target dynamics includes a model of how a tracked object is allowed to move, including physical restraints placed on a tracked object with respect to surroundings (i.e., a tracked object is not allowed to walk through a pillar located in the field of view). State estimates include object parameters (e.g., location, speed, direction) associated with an object at previous points in time. That is, if a tracked object changes direction a number of times indicated by previous state parameters, the confidence in the tracked object moving to a particular location decreases. The uncertainty propagation takes into account known uncertainties in the measurement process and variation of data. Statistical stationarity of the process assumes that past statistical assumptions made regarding the underlying process will remain the same.

Graphically, the covariance distribution illustrates the confidence associated with calculations regarding where the tracked object will travel as well as when the tracked object will arrive at particular location. A profile of the covariance distribution taken along axis 38 provides the probability of where the tracked object will be in the future. The most probable location of the tracked object is defined by the peak of covariance distribution. As the predicted path of the tracked object changes (as shown in FIG. 2A), the peak of the covariance distribution changes. A profile of the covariance distribution taken along axis 39 provides the probability or confidence associated with when the targeted object will reach elevator doors 33. The peak of the covariance distribution indicates the most probable time that the tracked object will reach elevator doors 33.

The confidence associated with a particular estimation (e.g., arrival, time) is defined by the sharpness of the covariance distribution. That is, a flat distribution indicates low confidence in a particular estimation, Whereas a sharp peak indicates a high level of confidence in a particular estimation. For example, as shown in FIG. 1A, as passenger P2 travels towards elevator doors 20, the covariance distribution becomes sharpened, with an increased confidence in passenger P2 reaching elevator doors 20, as well as passenger P2 reaching elevator doors at a particular time.

For passengers moving away from elevator doors 20, such as passenger P3, the covariance distribution associated with passenger P3 reaching elevator doors 33 indicates a decreased confidence (flat distribution) in passenger P3 arriving at elevator doors 20, as well as passenger P3 arriving at elevator doors 20 at a particular time.

When a passenger (such as passenger P1) reaches elevator doors 20, the passenger typically stops moving. Because estimated arrival time covariance is based on location, speed, and direction, a passenger that is no longer in motion (i.e., velocity=0, direction=undetermined) can cause the covariance calculation to show a loss in confidence (decreased sharpness) in an estimated arrival time. To solve this problem, a region R2 is defined around elevator doors 20, as shown in FIG. 1A. Video processor 16 provides as an assumption that all tracked objects that enter region R2 are in fact going to become elevator passengers. Video processor 16 identifies them as waiting passengers, with an estimated arrival time of zero. Video processor 16 keeps track of the number of waiting passengers, and provides elevator control 24 with this parameter as part of the passenger data parameters.

Providing the mean estimated arrival time, probability of arrival and the estimated arrival time covariance allows control system 24 to dispatch elevator 18 cab to a floor prior to a passenger pushing call button 22 (for instance, in response to estimated arrival time, probability of arrival, and covariance calculations associated with passenger P2). Furthermore, control system 24 can determine when to close elevator doors 20 based on whether additional passengers are predicted to arrive at elevator doors 20. For instance, if video processor 16 determines with a high level of confidence that a passenger (e.g., passenger P2) will reach elevator doors 20 within a defined amount of time, then control system 24 causes elevator doors 20 to remain open for an extended period of time. The opposite is also true, if video processor 16 does not determine with a high level of confidence estimated arrival times for other passengers (e.g., passenger. P3), control system 24 causes elevator doors 20 to close, decreasing the door dwell time and waiting time of passengers already in elevator cab 18.

The prediction of the future location of moving objects is described in further detail, e.g., by the following publications: Madhaven R., and Schlendoff, C., "Moving Object Prediction for Off-road Autonomous Navigation", Proc, SPIE Aerosense Conf. Apr. 21-25, 2003, Orlando, Fla.; and Ferryman, J. M., Maybank, S. J., and Worral, A. D., "Visual Survelliance For Moving Vehicles", Intl. J. of Computer Vision, v. 37, n. 2, pp. 187-197, June 2000. These articles describe predicting the future state (time and location) of an object as well as associated uncertainties (covariances) using algorithms such as Extended Kalman Filters (EKFs) and Hidden Markov Models (HMMs).

Classification of Object

Video processor 16 also provides control system 24 with classification data regarding objects tracked within the field of view of video camera 12. For example, video processor 16 is capable of distinguishing between different objects, such as people, carts, animals, etc. This provides control system 24 with data regarding whether an object is a potential elevator passenger or not, and also allows control system 24 to provide special treatment for particular objects. For instance, if video processor 16 determines that passenger P2 is a person pushing a cart, both the person and the cart would be considered potential passengers, since most likely the person would push the cart into elevator cab 18. If video processor 16 determines that passenger P2 is an unaccompanied dog, then video processor determines that passenger P2 is not a potential elevator passenger. Therefore, control system 24 would not cause elevator cab 18 to be dispatched, regardless of the location or direction of the passenger P2. In one embodiment, video processor 16 would not provide control system 24 with passenger data associated with objects classified as non-passengers.

Classification of an object allows control system 24 to take into account special circumstances when causing elevator doors 20 to open and close. For instance, if video processor 16 determines a person in a wheelchair is approaching elevator doors 20, it may cause elevator doors 20 to remain open for a longer interval.

An example of object classification is described in the following article: Dick, A. R., and Brooks, M. J, "Issues in Automated Visual Survelliance", Proc 7$^{th}$ Intl. Conf. on Digital Image Computing: Techniques and Applications (DICTA 2003), pp. 195-204, Dec. 10-12, 2003, Sydney, Australia; and Madhaven, R., and Schlendoff, C., "Moving Object Prediction for Off-road Autonomous Navigation", Proc, SPIE Aerosense Conf. Apr. 21-25, 2003, Orlando, Fla.

Estimated Object Area

Video processor 16 also provides control system 24 with an estimated floor area to be occupied by each tracked object. Depending on the orientation of video camera 12, different algorithms can be used by video processor 16 to determine the floor area to be occupied by a particular object. If video camera 12 is mounted above the area outside of elevator doors 20, then video processor 16 can make use of simple pixel mapping algorithm to determine the estimated floor area to be occupied by a particular object. If video camera 12 is mounted in a different orientation, probability algorithms may be used to estimate floor area based on detected features of the object (e.g., height, shape, etc.). In another embodiment, multiple cameras are employed to provide multiple vantage points of the area outside elevator doors 20. The use of multiple cameras requires mapping between each of the cameras to allow video processor 16 to accurately estimate floor area required by each tracked object.

Providing estimated floor area occupied by tracked objects allows control system 24 to determine whether additional elevator cabs (assuming more than one elevator cab is employed) are required to meet passenger demand. For instance, if video processor 16 determines that passengers P1 and P2 are likely elevator passengers, but that passenger P1 is pushing a cart that will occupy the entire available floor space in elevator cab 18, then control system 24 will cause a second elevator cab to be dispatched for passenger P2.

In another embodiment, control system 24 receives further input regarding available floor space within elevator cab 18 (for instance, if video camera 32 is mounted within elevator cab 18 as shown in FIG. 1B). Based on video input received from video camera 32, if video processor 16 determines that no space is available in elevator cab 18, then control system 24 causes elevator cab 18 to bypass floors with waiting passengers until there is room for them in elevator cab 18.

An example of area estimation is described in the following article: P. Merkus, X. Desurmont, E. G. T Jaspers, R. G. J. Wijnhoven, O. Caignart, J-F Delaigle, and W. Favoreel, "Candela—Integrated Storage, Analysis and Distribution of Video Content for Intelligent Information Systems." http://www.hitech-projects.com/euprojects/candela/pr/ewimtfinal2004.pdf.

Number of Waiting Passengers

Video processor 16 also provides control system 24 with information regarding number of passengers waiting for elevator cab 18. As discussed above, when a tracked object crosses into region R2, video processor 16 assumes that the tracked object will in fact become an elevator passenger. For each tracked object that enters region R2 on an appropriate trajectory and not from within elevator cab 18, video processor 16 increments the number of waiting passengers parameter provided to control system 24. Providing this parameter to control system 24 allows control system 24 to determine whether to dispatch additional elevator cabs to a particular floor. The number of waiting passengers parameter may also be used by control system 24 to determine when to close elevator doors 24. For instance, if video processor 16 determines that passengers P1 and P2 are waiting for elevator cab 18, control system 24 will cause door control 28 to keep elevator doors 20 open until both passengers are detected entering elevator cab 18.

Object ID (Authorization)

Video processor 16 receives authentication data from access control system 14, and provides authorization data associated with each tracked object to control system 24. Video processor 16 may also provide authorization data associated with each tracked object to access control system 14, allowing access control system 14 to detect or prevent detected security breaches.

Depending on the type of access control system 14 in place, authorization may occur prior to a passenger reaching elevator doors 22, at elevator doors 22, or within elevator cab 18. When a passenger becomes authorized, either to enter the elevator or to enter a particular floor, video processor 16 associates the authorization received from access control system 14 with the particular passenger. Depending on the type of access control system in place, control system 24 uses object ID provided by video processor 16 to prevent or alert security system 30 to detected security breaches, such as "piggybacking" and "card pass-back." By unambiguously associating each particular passenger with an authorization status, control system 24 is able to detect and respond to potential security breaches.

Figure 3:
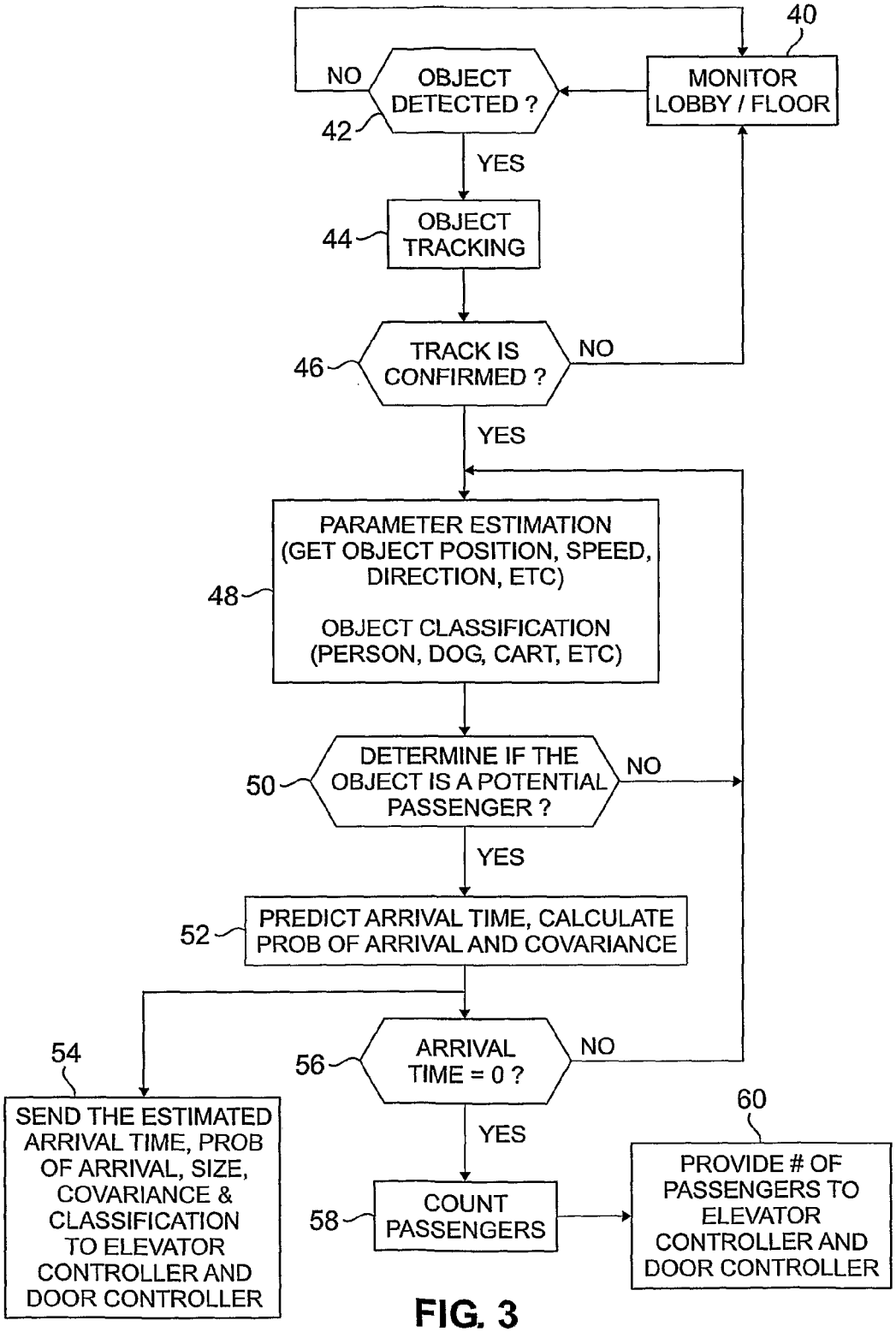
FIG. 3 is a flowchart illustrating processing of parameters by the video processor.

FIG. 3 is a flow chart illustrating calculation of passenger data (not including object ID data) by video processor 16. At step 40, video processor 16 monitors the area outside of elevator doors 20 (as shown in FIGS. 1A and 1B). At step 42, video processor 16 determines whether an object has entered the field of view (specifically region R1) of video camera 12. In one embodiment, video processor 16 determines if an object has entered the field of view of video camera 12 using a motion detection algorithm. In another embodiment, video processor 16 is alerted to the presence of an object carrying radio frequency identification (RFID) tags. If video processor 16 does not determine that an object has entered the field of view of video camera 12, then video processor 16 continues monitoring at step 40. If an object is detected within the field of view of video camera 12, then at step 44 video processor 16 begins "tracking" the object. In order to perform the calculations necessary to provide passenger data to control system 24, video processor 16 must be able to identify and associate an object at different points in time (and different locations), using a process known as tracking. That is, once an object has been detected, in order to perform useful calculations regarding the speed, direction, etc., of the object, video processor 16 must be able to keep track of the object as it moves within the field of view of video camera 12.

At step 46, if tracking of an object is confirmed, then video processor 16 calculates object parameters associated with the tracked object at step 48. Although not exclusive, object parameters calculated by video processor 16 include position, velocity, direction, size, classification, and acceleration of the tracked object. At step 50, object classification determined at step 48 is used to determine whether an object is a potential passenger. For instance, an object identified as an unaccompanied dog would not be classified as a potential passenger. If video processor 16 determines that an object is not a potential passenger, it will continue to monitor and track the object (at step 48), but will not provide passenger data parameters associated with the object to control system 24.

If video processor 16 determines than an object is a potential passenger, then at step 52, video processor 16 calculates passenger data including estimated arrival time and probability of arrival parameters such as covariance. As discussed above, estimated arrival time and probability of arrival (as well as any other passenger data parameters) are determined by video processor 16 based on object parameters calculated at step 48 by video processor 16. At step 54, video processor 16 provides control system 24 with passenger data (e.g., estimated arrival time, covariance, probability of arrival, size, and classification, etc.). At step 56, video processor 16 checks whether the estimated arrival time of a passenger equals zero. When the estimated arrival of a passenger equals zero (e.g., tracked object enters region R2), video processor 16 determines that the passenger is waiting for the elevator, and increments the number of passengers currently waiting for the elevator at step 58. At step 60, video processor 16 provides control system 24 with the number of passengers waiting outside elevator doors 20. If the estimated arrival time is not equal to zero, then video processor 16 will continue tracking and calculating object parameters at step 48.

Figure 4:
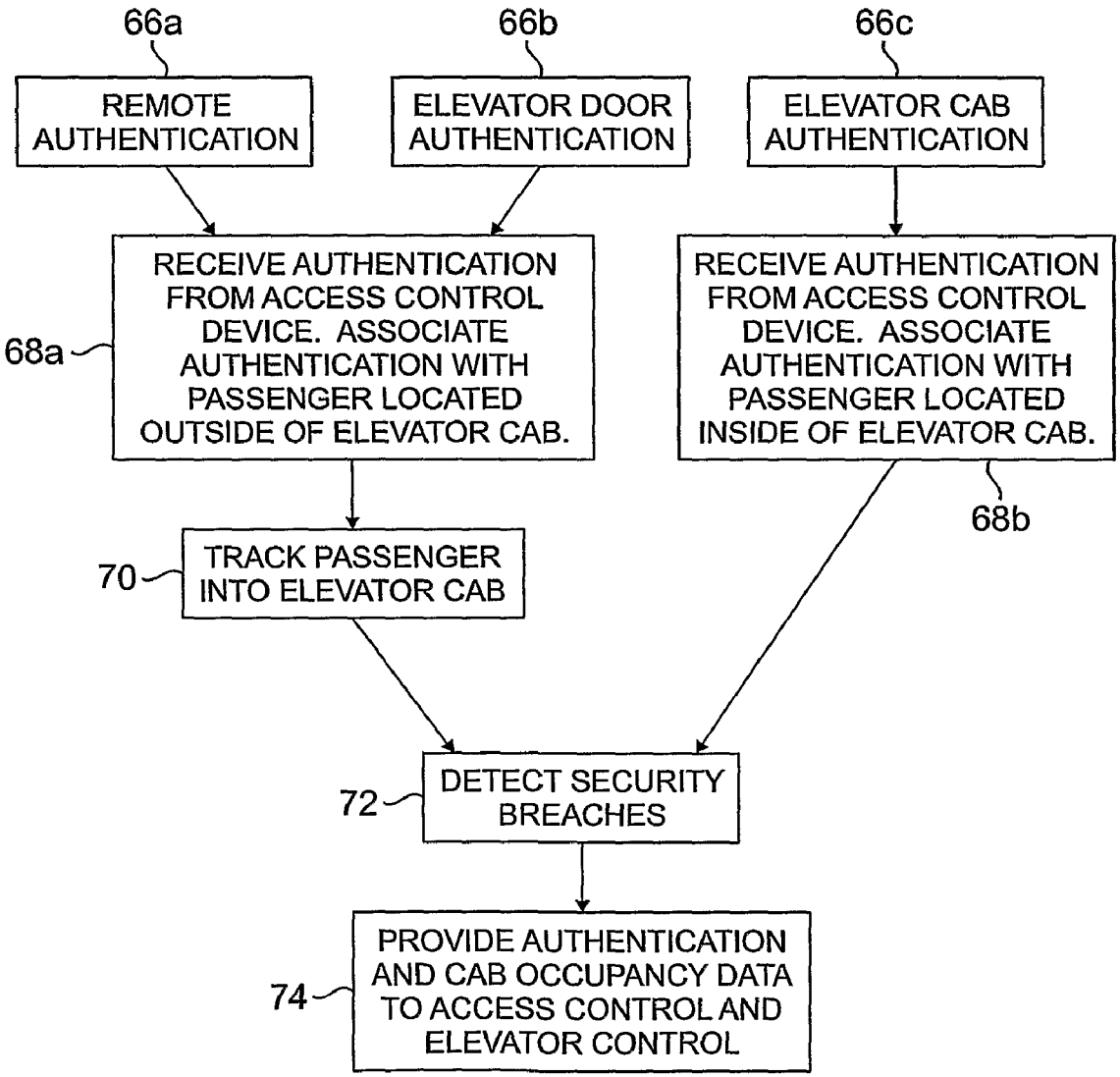
FIG. 4 is a flowchart of access control methods implemented by the present invention.

FIG. 4 is a flowchart illustrating methods employed by the video aided system of the present invention for providing access control to elevator systems 10*a* and 10*b*. Access control of an elevator system varies depending on the type of access control to provide. For instance, in one scenario elevator cab 18 only provides passage to secure floors. In this scenario, every passenger located within elevator cab 18 at the closing of elevator doors 20 must have a unique authorization. If video processor 16 notifies control system 24 of an unauthorized passenger, elevator cab 18 may act as an airlock (i.e., man-trap) until security can be notified and the unauthorized user is detained. Alternatively, elevator cab doors 20 may not be closed if an unauthorized user is detected within elevator cab 18. In another scenario, elevator cab 18 travels to some floors that are secure, and other floors that are non-secure or public. In this scenario, authorized and unauthorized users are both allowed to enter elevator cab 18, but only authorized users should exit elevator cab 18 at secure floors. If video processor 16 detects unauthorized passengers exiting onto floors requiring authorization then video processor 16 signals control system 24 which, in turn, signals security system 30.

Regardless of the access control scenario, the first step in providing access control is determining authorization of a passenger. FIG. 4 illustrates three methods of determining passenger authorization, including remote authorization 66*a*, elevator door authorization 66*b*, and elevator cab authorization 66*c*. In each of these methods, the authorization may be cooperative (e.g., keypad entry, voice recognition, access card swipe, etc.) or passive (e.g., RFID tag, facial recognition, etc.). As discussed above, upon identifying a passenger as authorized, the authorization data is provided to video processor 16, which unambiguously associates the authorization with a particular passenger within the field of view of video camera 12 or video camera 32.

In the remote authorization method, passengers are remotely identified as authorized as they approach elevator doors 20. A number of methods exist for remotely identifying users as authorized. For example, in one embodiment, RFID tags are used to identify objects or passengers as authorized. In the elevator door authorization method 66*b*, authorization is provided at elevator doors 20. This method may make use of swipe cards, voice recognition, or keypad entry in determining authorization of a passenger. In elevator cab authorization method 66*c*, authorization is provided inside of elevator cab 18, and may make use of swipe cards, voice recognition or keypad entry.

If remote authorization 66*a* or elevator door authorization 66*b* is employed, then access control system 14 provides authorization data to video processor 16 at step 68*a*, allowing video processor 16 to unambiguously associate authentication to a particular passenger located outside of elevator cab 18. If elevator cab authentication 66*c* is employed, then access control system 14 provides authorization data to video processor 16 at step 68*b*, allowing video processor 16 to unambiguously associate authentication to a particular passenger within elevator cab 18. In this embodiment, it would be beneficial to have a video camera within elevator cab 18 (as shown in FIG. 1B), allowing video processor 16 to use video received from the interior of elevator cab 18 to associate authorization with a particular user. In the alternative, video input received from video camera 12 located outside of elevator cab 18 allows video processor 16 to determine the number of people that enter elevator cab 18, and therefore identify the number of unique authorizations that should be detected. Because in each of these methods, video processor 16 unambiguously identifies each authentication with a monitored passenger, attempts to use a single authorization to admit two or more passengers (e.g., card pass back or piggybacking) can be detected.

If authorization is determined outside of elevator cab 18 (using either the first or second method) then at step 70 video processor 16 monitors or tracks passengers (authorized and unauthorized) as they enter elevator cab 18.

Once the passengers are in elevator cab 18, at step 72 control system 24 uses the authorization data provided by video processor 16 (regardless of the method employed to obtain authorization data) to detect security breaches, such as tailgating. In scenarios in which elevator cab 18 only travels to secure floors, at the time of door closing each passenger within elevator cab 18 must be unambiguously identified with a particular authorization. If an unauthorized passenger is located within elevator cab 18 at the time of door closing, control system 24 alerts security system 30 at step 74. In one embodiment, control system 24 may act as an airlock, by causing elevator doors 20 to remain closed until security arrives. In other embodiments, control system 24 prevents elevator cab 18 from being dispatched to a secure floor until the unauthorized user leaves elevator cab 18. In scenarios in which some floors accessed by elevator cab 18 are secure, and other are not, then passengers must be monitored within elevator cab 18 to determine if an unauthorized user has gotten off on an authorized floor. This can be done with video surveillance within elevator cab 18 (as shown in FIG. 1B), or by other means capable of detecting when elevator cab 18 is empty (e.g., monitor weight of elevator cab 18). If video surveillance is employed within elevator cab 18, then video processor 16 is able to associate each passenger with an authorization status. If video processor 16 determines that an unauthorized passenger exits onto a secure floor, then control system 24 notifies security of the breach at step 74.

Figure 5:
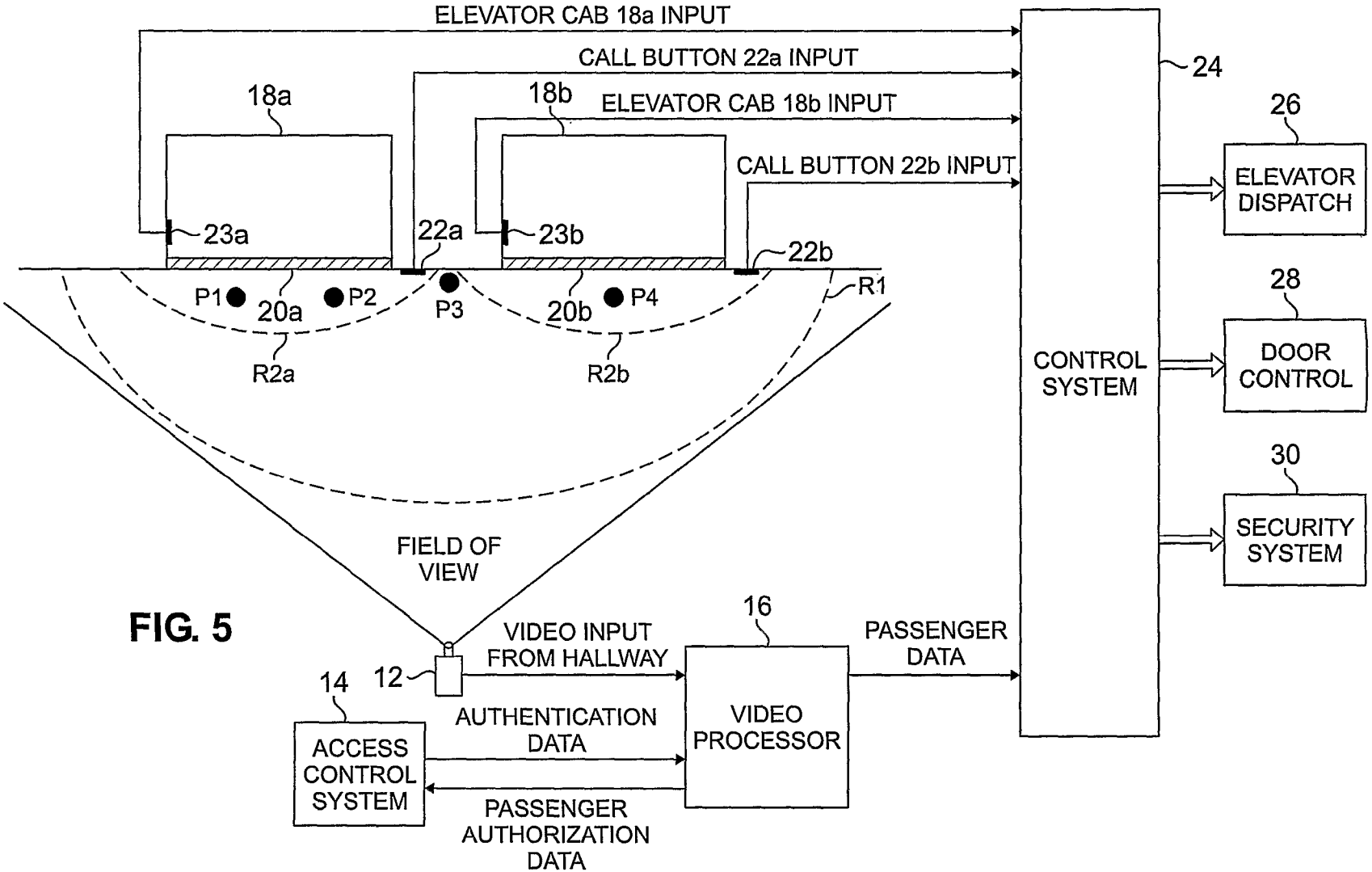
FIG. 5 is a schematic/functional block diagram of another embodiment of the video aided elevator and access control system of the present invention.

FIG. 5 shows an embodiment of the present invention employing a pair of elevator cabs located next to one another. In other embodiments, a plurality of elevator cabs may be employed, but for the sake of simplicity, only a pair of elevator cabs 18*a* and 18*b* are shown in FIG. 5. As discussed above with respect to FIG. 1A, video processor 16 receives video data from video camera 12 and access control data from access control system 14. Video processor 16 performs a number of calculations and provides a set of passenger data to control system 24. Based on passenger data received from video processor 16, control system 24 provides control signals to elevator dispatch 26, elevator door control 28 and security system 30. Elevator dispatch 26 and elevator door control 28 causes at least one of elevator cabs 18*a* and 18*b* to be dispatched, and elevator doors to be opened and closed based on the passenger data received from video processor 16. As discussed above, video camera 12 monitors and tracks objects in region R1, providing passenger data parameters to control system 24. When a tracked object reaches region R2*a* or region R2*b*, video processor 16 estimates the arrival time of the tracked object to be zero, and assumes that tracked objects in these regions are in fact waiting for an elevator. For instance, video processor 16 would indicate to control system 24 that two passengers (Passenger P1 and Passenger P2) are waiting for elevator cab 18*a*, and one passenger (Passenger P4) is waiting for elevator cab 18*b* (Passenger P4). However, a problem arises when Passenger P3 waits for an elevator at the intersection of regions R2*a* and R2*b*. It is difficult to determine whether passenger P3 is waiting for elevator cab 18*a* or 18*b*. Therefore, in one embodiment, video processor 16 numerically divides passenger P3 into two parts. One half of passenger P3 is assumed to be waiting for elevator cab 18*a* and the other one half of passenger P3 is assumed to be waiting for elevator cab 18*b*. Therefore, video processor 16 would indicate to control system 24 that two and a half passengers are waiting for elevator cab 18*a* and one and a half passengers are waiting for elevator cab 18*b*. Although in reality, passenger P3 will either enter elevator cab 18*a* or elevator cab 18*b*, this solution takes into account the presence of passenger P3 without assuming the intentions of passenger P3.

Although the present invention has been described with reference to preferred embodiments, workers skilled in the art will recognize that changes may be made in form and detail without departing from the spirit and scope of the invention.

The invention claimed is:

1. A video aided elevator control system comprising:

a video camera for capturing video images of an elevator door and surrounding area within a field of view of the video camera;

a video processing device connected to receive the video images from the video camera, wherein the video processing device uses the video images provided by the video camera to track an object, and calculates passenger data associated with the tracked object; and an elevator controller connected to receive the passenger data from the video processing device, wherein the elevator controller controls at least one of elevator dispatch and elevator door control functions based on the passenger data provided by the video processing device.

2. The video aided elevator control system of claim 1, wherein the video processing device calculates at least one of the following object parameters with respect to the tracked object, including: location, size, direction, acceleration, velocity, and object classification.

3. The video aided elevator control system of claim 2, wherein the video processing device provides the object parameters to the elevator controller.

4. The video aided elevator control system of claim 2, wherein the video processing device calculates the passenger data based on the object parameters, wherein the passenger data provided to elevator controller includes at least one of the following: estimated arrival time, probability of arrival, covariance, and number of passengers waiting for an elevator.

5. The video aided elevator control system of claim 4, wherein the video processing device calculates the passenger data if the tracked object is classified as a passenger.

6. The video aided elevator control system of claim 4, wherein the video processor divides the video camera's field of view into a first region and a second region, wherein the second region is defined as an area immediately surrounding the elevator doors.

7. The video aided elevator control system of claim 6, wherein the video processor increments the number of passengers waiting for an elevator parameter based on a number of tracked objects that enter the second region.

8. The video aided elevator control system of claim 1, further comprising:

an access control system connected to provide authorization data to the video processing device, wherein the video processing device associates the authorization data with the tracked object and provides authorization status of the tracked object to the elevator controller.

9. The video aided elevator control system of claim 8, wherein the video; processing device provides the authorization data associated with the tracked object to the access control system.

10. The video aided elevator control system of claim 1, further including:

a second video camera for capturing video images in the interior of an elevator cab, wherein the video processing device uses the video images provided by the second video camera to track a passenger within the elevator cab and calculate usage and passenger data parameters with respect to the passenger within the elevator cab.

11. The video aided elevator control system of claim 10, wherein the usage data calculated by the video processing device includes at least one of the following: number of passengers within the elevator cab and floor space available in the elevator cab.

12. The video aided elevator control system of claim 11, further including:

an access control device connected to provide authorization data to the video processing device, wherein the video processing device associates authorization data with the passenger within the elevator cab and provides authorization status of the passenger within the elevator cab to the elevator controller.

13. A method of providing video aided data for use in elevator control, the method comprising:

detecting an object located in an elevator hall outside an elevator door;

tracking the object based on successive video images received from at least one video camera;

calculating passenger data associated with the tracked object; and providing the passenger data to an elevator controller, wherein the elevator controller causes at least one of an elevator cab to be dispatched, elevator doors to be opened, and elevator doors to be closed based on the passenger data provided.

14. The method of claim 13, wherein detecting an object includes:

employing a motion detection algorithm to detect when the object enters the field of view of the at least one video camera.

15. The method of claim 13, wherein detecting an object includes:

employing radio frequency identification (RFID) devices to determine when the object has entered the field of view of the at least one video camera.

16. The method of claim 13, wherein calculating passenger data includes:

calculating at least one of the following object parameters for the tracked object, including: location, size, velocity, direction, acceleration, and object classification.

17. The method of claim 16, wherein calculating passenger data further includes:

calculating at least one of the following passenger data parameters based on the object parameters calculated with respect to the tracked object, including: estimated arrival time of the object; probability of arrival; covariance; and number of passengers waiting for an elevator.

18. The method of claim 17, wherein calculating the number of passengers waiting for an elevator includes:

determining a number of tracked objects to enter a first region surrounding the elevator doors, wherein the first region defines an area in which elevator passengers typically wait for elevator service.

19. The method of claim 17, further including:

dispatching an elevator cab to a particular floor based on the passenger data received by the elevator controller, wherein the elevator controller dispatches the elevator cab to a particular floor prior to a passenger requesting elevator service through a call button.

20. The method of claim 17, further including:

controlling the opening and closing of the elevator doors based on the passenger data received by the elevator controller, wherein the elevator controller causes the elevator doors to remain open if the passenger data indicates arrival of an additional passenger at the elevator doors, and wherein the elevator controller causes the elevator doors to close if the passenger data indicates no additional passengers arriving at the elevator doors.

21. The method of claim 17, further including:

monitoring an interior of an elevator cab using video images received from a second video camera mounted within the elevator cab;

calculating estimated floor space available in the elevator cab based on the video images received from the second video camera; and providing the calculated estimated floor space to the elevator controller, wherein the elevator controller bases elevator operation on the estimated floor space available and the number of passengers waiting for elevator service at a particular floor.

22. The method of claim 13, further including:

determining authorization status of the tracked object by associating authorization data received from an access control device with the tracked object; and providing authorization status of the tracked object to the elevator controller.

* * * * *

UNITED STATES PATENT AND TRADEMARK OFFICE

CERTIFICATE OF CORRECTION

PATENT NO. : 8,020,672 B2
APPLICATION NO. : 12/087217
DATED : September 20, 2011
INVENTOR(S) : Lin Lin et al.

It is certified that error appears in the above-identified patent and that said Letters Patent is hereby corrected as shown below:

Col. 6, Line 61
Delete "Whereas"
Insert --whereas--

Col. 13, Line 31
Delete ";"

Signed and Sealed this
Twenty-second Day of November, 2011

David J. Kappos
*Director of the United States Patent and Trademark Office*